US005678950A

United States Patent [19]

Junker

[11] Patent Number: 5,678,950

[45] Date of Patent: Oct. 21, 1997

[54] GUIDE ARRANGEMENT FOR GUIDE WALLS

[76] Inventor: Wilhelm Junker, Reutlinger Strasse 14, 71501 Backnang, Germany

[21] Appl. No.: 522,400

[22] PCT Filed: Mar. 8, 1994

[86] PCT No.: PCT/EP94/00692

§ 371 Date: Sep. 18, 1995

§ 102(e) Date: Sep. 18, 1995

[87] PCT Pub. No.: WO94/21861

PCT Pub. Date: Sep. 29, 1994

[30] Foreign Application Priority Data

Mar. 19, 1993 [DE] Germany ..... 9304134 U
Aug. 25, 1993 [DE] Germany ..... 9312689 U

[51] Int. Cl.[6] ..... E01F 15/00

[52] U.S. Cl. ..... 404/10; 40/606; 40/612

[58] Field of Search ..... 404/6, 9, 10, 13; 256/13.1; 116/63 R, 63 P; 40/606, 608, 612

[56] References Cited

U.S. PATENT DOCUMENTS

| | | | |
|---|---|---|---|
| 3,564,984 | 2/1971 | Alexander | 404/9 X |
| 4,050,401 | 9/1977 | Kelly | 404/6 X |
| 4,249,832 | 2/1981 | Schmanski | 404/6 |
| 4,298,075 | 11/1981 | Sweeney | 404/9 X |
| 4,569,495 | 2/1986 | Woudenberg et al. | 40/608 X |
| 4,782,783 | 11/1988 | Kulp et al. | 404/9 X |
| 4,796,369 | 1/1989 | Hamann | 116/63 P X |
| 5,040,478 | 8/1991 | Hughes | 40/608 X |

FOREIGN PATENT DOCUMENTS

| | | | |
|---|---|---|---|
| 2540533 | 8/1984 | France | 256/13.1 |
| 2650846 | 2/1991 | France | 404/6 |
| 2688242 | 9/1993 | France | 404/6 |

*Primary Examiner*—James Lisehora
*Attorney, Agent, or Firm*—Bardehle, Pagenberg, Dost, Altenburg, Frohwitter, Geissler & Partners

[57] ABSTRACT

The invention is concerned with producing a visual guiding effect for guide walls which are difficult to see particularly at dusk and in the dark. According to the invention, the guide arrangement comprises a holder which is to be mounted on the guide wall and is provided with a retaining arm, which is elastically resilient at least in the horizontal direction, and a guide member which is mounted on the retaining arm by a coupling device and is provided on at least one side with a guide face which is clearly visible even in conditions of poor visibility.

15 Claims, 5 Drawing Sheets

GUIDE ARRANGEMENT FOR GUIDE WALLS

On trunk roads, which have heavy vehicular traffic and where a central strip with protective panels is usually disposed between the roadways, rigid guide walls are erected in an area of long-term roadworks as a means for guiding the contraflows of traffic on one side of the roadway at the boundary between the roadways. Such walls generally comprise wall sections of a relatively short length, which are interconnected by means of coupling devices at their end faces to form a continuous guide wall. These guide walls have a height of approx. 820 mm and a width at the base of approx. 600 mm. the base is provided on both sides with upwardly inclined deflection faces. Thereabove, the guide walls have an approximately cuboid configuration. When viewed in vertical section, there is a neck-shaped constriction in the upper region, and said constriction is upwardly defined by a hammer-head-shaped portion. The guide walls are sometimes produced as hollow plastics material bodies, which are weighted with a filling of water or sand, or they are produced from metal, likewise as hollow bodies, and they are additionally weighted with a filler substance depending on the actual weight attained. Other guide walls are configured as solid moulded concrete parts.

Because of their great weight and the resultant stability, the guide walls have a good deflection effect against colliding vehicles which are thereby safeguarded from moving into the opposite roadway and causing serious accidents there. However, the deflection effect cannot prevent a colliding motor vehicle from skidding in its own roadway and causing an accident, more especially when this roadway has two lanes, in that the deflected and possibly skidding vehicle strikes vehicles travelling parallel thereto or collides with them or is struck by subsequent vehicles. In consequence, the guide walls should also provide a minimum amount of visual guidance in addition to their purely mechanical deflection effect, so that a collision is also avoided. Because of their nature, however, guide walls made of metal and, even more, guide walls made of concrete provide only a minimal, inherent visual guidance, more especially at dusk and in the dark. This visual guidance is quite considerably worsened when the guide walls have become wet during rain or as a result of water sprayed on their external surfaces. The concrete walls in particular then have an even duller and darker appearance than in their dry state. They are thereby scarcely distinguished from a dark wet roadway. When the vehicle drivers are travelling along said roadway, this causes considerably uncertainty, leading to anxiety and stiffness, as a result of which the risk or colliding with the guide wall or even with vehicles travelling parallel thereto is even increased by the guide wall.

A guide arrangement for guide walls is disclosed in U.S. Pat. No. 3,564,984. In the known guide arrangement, a retaining foot is provided, which laterally abuts against a guide panel or the like with an abutment face. A guide member, which is provided with a guide face, is connected to the retaining foot by a type of bayonet closure. There is no provision for changing the dimensions of the guide arrangement. Likewise, there is little assurance that the retaining arm, which protrudes laterally from the retaining foot, can easily yield with the guide member if struck by a vehicle.

An alternative guide arrangement is described in FR-A-2 615 540. In the embodiment of FIGS. 2 and 3 of this publication, which relates to the mounting of the guide arrangement on a guide wall, a clamp is provided, which is slipped from above over the guide wall, and the arms of which clamp have holders mounted thereon with the interposition of a plate. Guide members, which are provided with a reflective guide face and can assume a slight inclined position, are disposed on the holders. There is no retaining arm here, which protrudes from a retaining foot, and there is also no mention of the guide members being elastically resilient.

The basic object of the invention is to develop further a guide arrangement of the type which is presumed known, so that it is possible to change its horizontal dimensions, yet such arrangement has a very simple configuration and can avoid damaging colliding vehicles.

This object is achieved with an arrangement having the features of the present invention.

The guide arrangement can be mounted by means of its retaining foot on the side of the guide walls, especially in the region of the neck-shaped constriction, at certain spacings one behind the other. In consequence, the guide face of its guide member faces the stream of traffic flowing along and is already distinguished clearly by the guide walls and provides a clearly visible visual guidance without adversely affecting this guiding effect, the guide arrangement can be so selected in respect of its horizontal dimensions and disposition that it does not protrude beyond the outline projection of the base of the guide walls. If some of them are nevertheless struck by a vehicle, their retaining arm yields resiliently, so that the guide member is moved out of the sphere of movement of the vehicle and can return again into its old position after the vehicle has passed. The component parts of the guide arrangement are produced advantageously from a plastics material which, on the one hand, is elastically resilient and, on the other hand, is very tough, whereby the visibility of the guide arrangement, more especially of the guide member, is not reduced even when wet, so that at least the guide arrangements remain clearly visible even if the guide walls are scarcely distinguishable from their surrounds. Because of the coupling device, the holder and the guide member can be produced separately from each other. If one of the two component parts becomes damaged, the other component part can continue to be used.

With a limited horizontal expansion of the guide arrangement, however, a relatively large guide face is provided by a guide member which has an approximately rectilinear configuration.

Despite the relatively large dimensions of the guide member, a circumferential reinforcing rib ensures adequate stability of shape, which is advantageous for its guiding effect.

In a further embodiment, the holder is provided with a relatively simple basic configuration which can accordingly be produced inexpensively. The retaining foot can also be relatively easily mounted on the guide walls. The reinforcing rib on the retaining arm ensures that, despite the retaining foot having adequate resilience, there is a minimum amount of restoring force, so that the guide member rapidly returns again into its operative position if it has temporarily been pushed aside by a colliding vehicle. This is also supported by a further embodiment comprising multiple reinforcing ribs.

In a still further embodiment, the guide member can be rotated relative to the retaining arm about the longitudinal axis of the headed screw and set, so that the guide member can also be orientated vertically when the holder is inclined upwardly or downwardly, because the mounting location of the retaining foot is not vertically orientated. The same also applies to an embodiment, where additionally the headed screw is non-detachably formed partially on the guide member. Such an arrangement also facilitates and accelerates the assembly of the guide arrangement, which is of great significance especially when guide members have to be replaced on a guide wall, past which the traffic flows.

A further development facilitates the shaping of the headed screw on the guide member. Furthermore, in such case, both the guide member and the retaining arm are reinforced at the coupling location, so that they have greater durability.

With another embodiment of the invention, it is possible to adjust the guide member relative to the holder in a horizontal direction within a certain range. The guide arrangement can therefore be adjusted more easily to guide walls having a variable outline.

In an additional embodiment, the coupling device operates with form-locking, which has the advantage that the position of the guide member is still maintained even if the screw connection has a certain amount of looseness. Other embodiments to a particular type of form-locking, which permits the position of the guide member to be changed relative to the spacing from the guide wall and relative to the inclination from the vertical.

A particularly simple adjustment device is provided by an embodiment, where there is only one loose component part for the screw connection. Embodiments of the invention which have colored markings or a reflective film on the guide face of the guide member improve quite considerably the visual guiding effect of the guide arrangement.

The invention is explained more fully hereinafter with reference to embodiments illustrated in the drawing. In the drawing.

Figure 1:
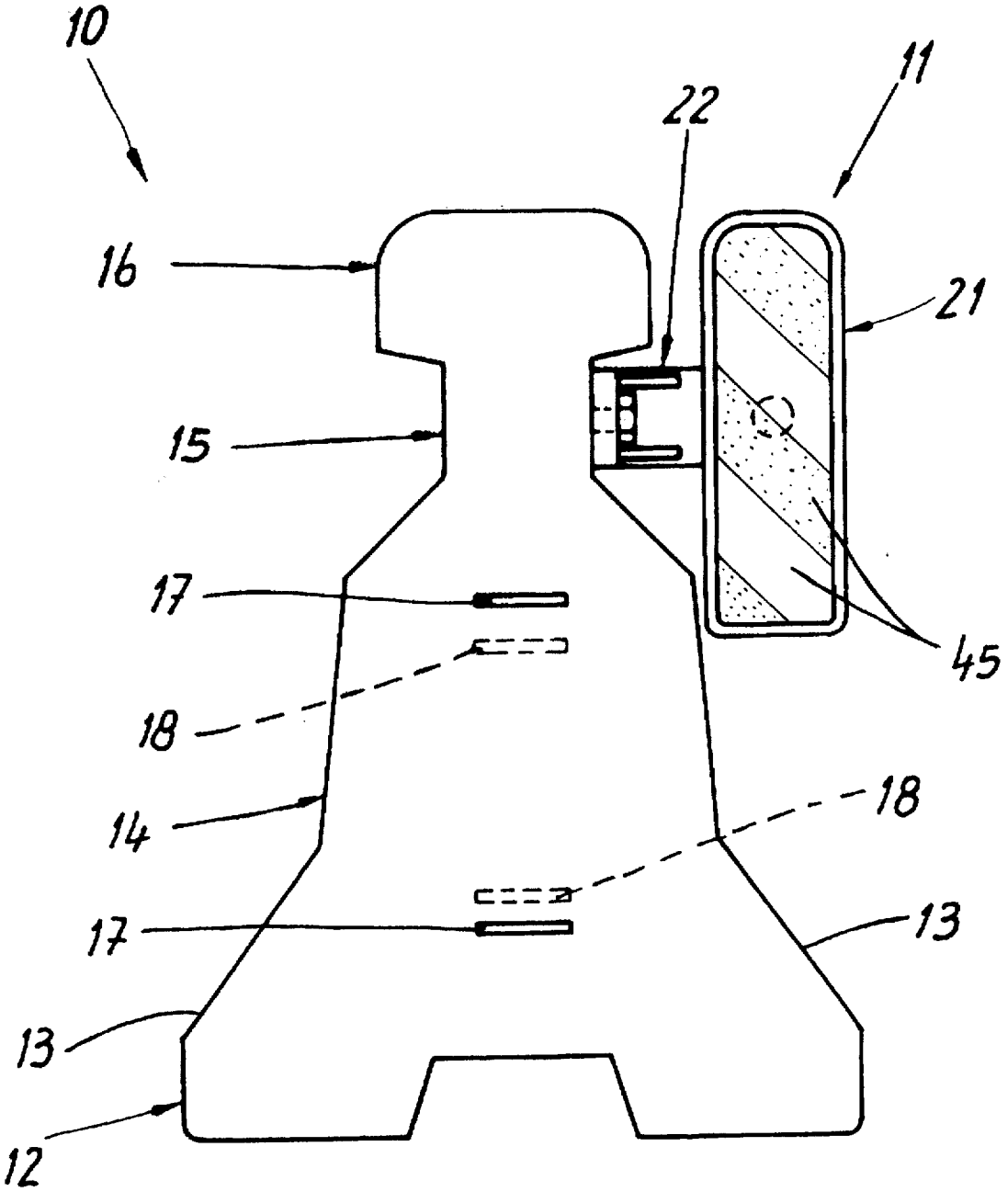
FIG. 1 is an end view of a guide wall having a guide arrangement mounted thereon.

A guide wall 10, having a guide arrangement 11 mounted thereon, is apparent from FIG. 1.

The guide wall element 10 is configured as a shaped reinforced concrete part. The element has a height of approx. 820 mm and a length of approx. 1000 mm. It has a base 12, which has a width of approx. 600 mm. The base 12 has an upwardly inclined deflection face 13 on both sides. An approximately cuboid central portion 14 is connected to the base 12. When viewed in vertical section, said central portion extends into a neck portion 15, to which is connected a head portion 16 in an upward direction. Two coupling elements 17 and 18 are provided on each of the two end faces of the guide wall element 10 and each have a through-slot, said through-slots being in alignment with each other in a vertical direction. The coupling elements 17 and 18 are on the line of symmetry at variable spacings from each other and at varying heights, so that the coupling elements can be brought to coincide with each other in a vertical direction when a plurality of guide wall elements are coupled together to form a continuous guide wall, and then a coupling pin, which is not shown, can be inserted into each of the through-slots, whereby the elements adjacent one another are interconnected.

Guide arrangements 11 are disposed on a continuous guide wall at certain spacings from one another, i.e. on individual guide wall elements 10. They are generally mounted in the region of the neck portion 15, that is to say screw-connected thereto by means of dowels and headed screws.

A guide arrangement 11 has a guide member 21 and a holder 22, which component parts are interconnected by means of a coupling device 23.

Figure 3:
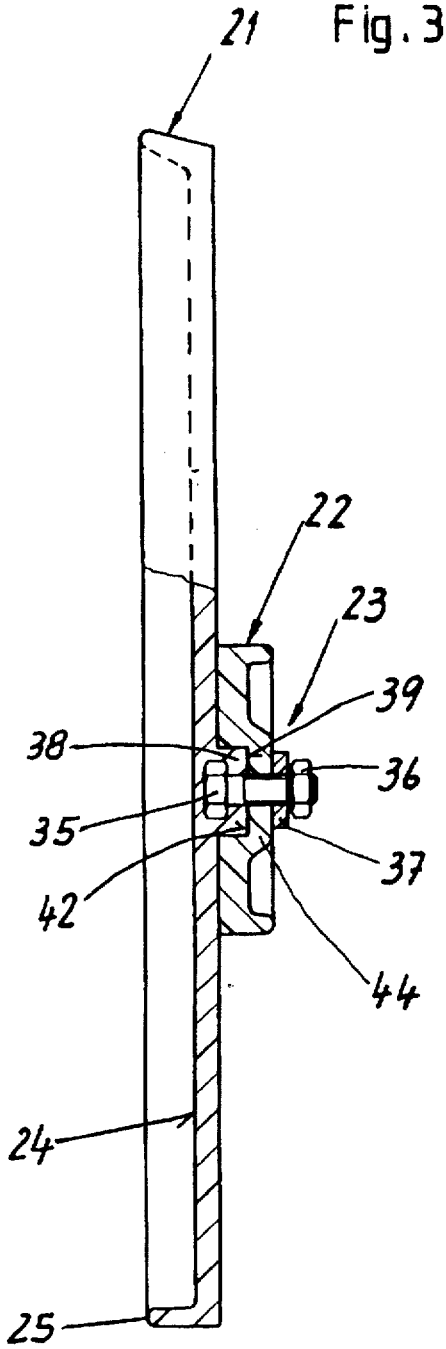
FIG. 3 is a side elevational view of the guide arrangement, shown partially in section.
Figure 2:
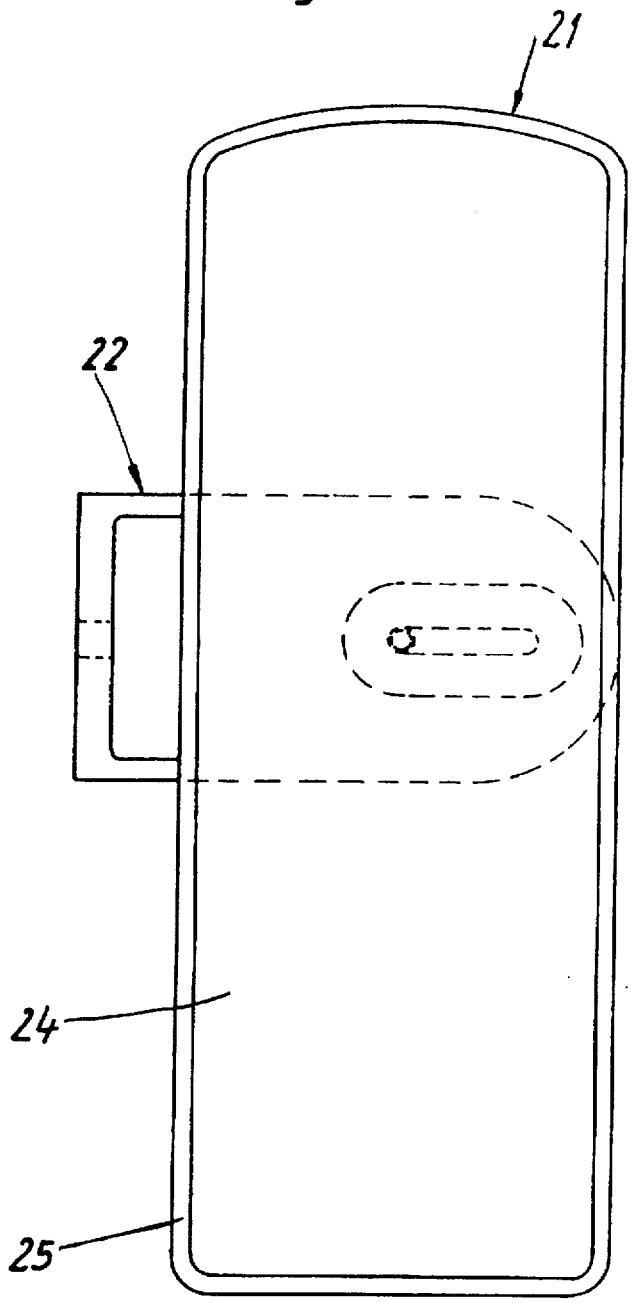
FIG. 2 is a view of the guide arrangement on its own.

The guide member 21 has an approximate rectangular configuration (FIG. 2), the upper edge region of which is curved in a slightly arcuate manner. The guide member 21 has a guide face 24 on the side remote from the holder 22. Said guide face is surrounded at the edge by a circumferential reinforcing rib 25 (FIG. 3). The guide member 21 is produced from an elastically resilient, but very tough plastics material.

Figure 4:
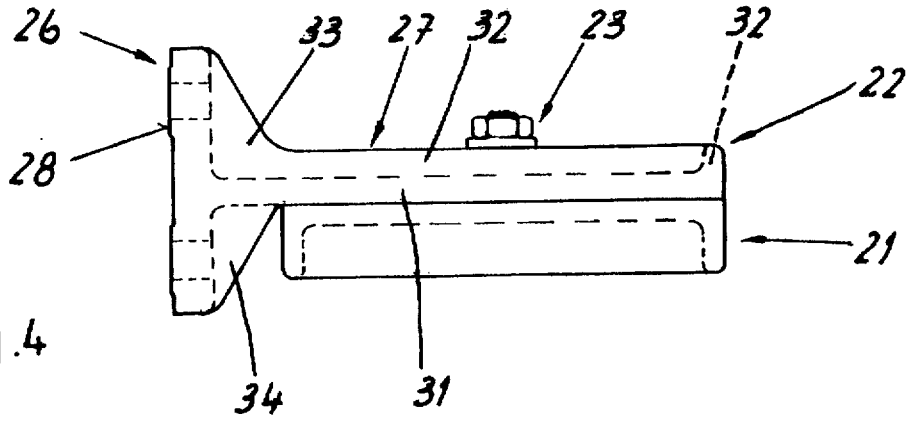
FIG. 4 is a plan view of the guide arrangement.
Figure 5:
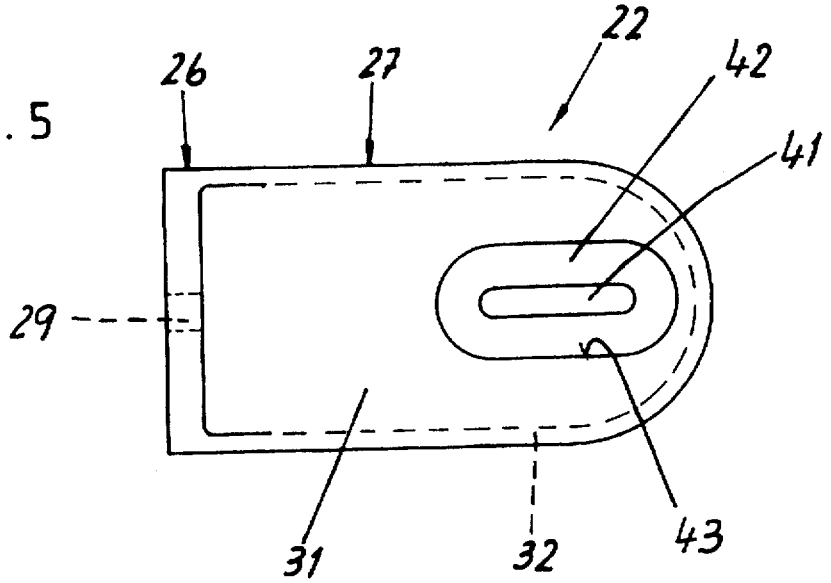
FIG. 5 is a view of a holder for the guide arrangement.
Figure 6:
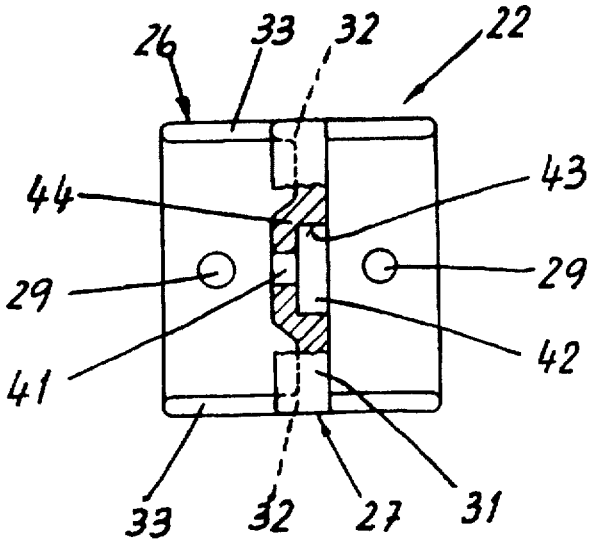
FIG. 6 is a side elevational view of the holder for the guide arrangement, shown partially in section.
Figure 8:
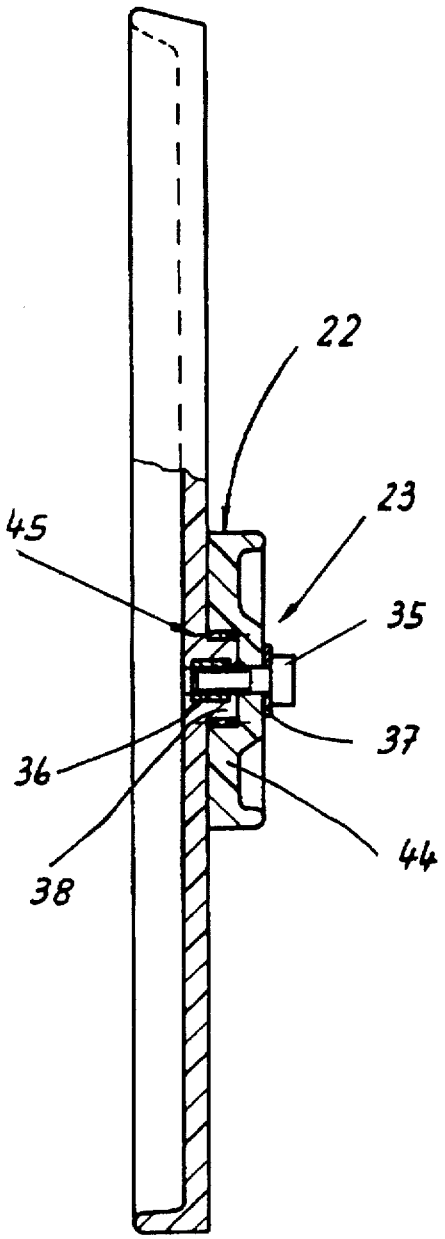
FIG. 8 is a view, corresponding to FIG. 3, of the subject-matter of FIG. 7.
Figure 7:
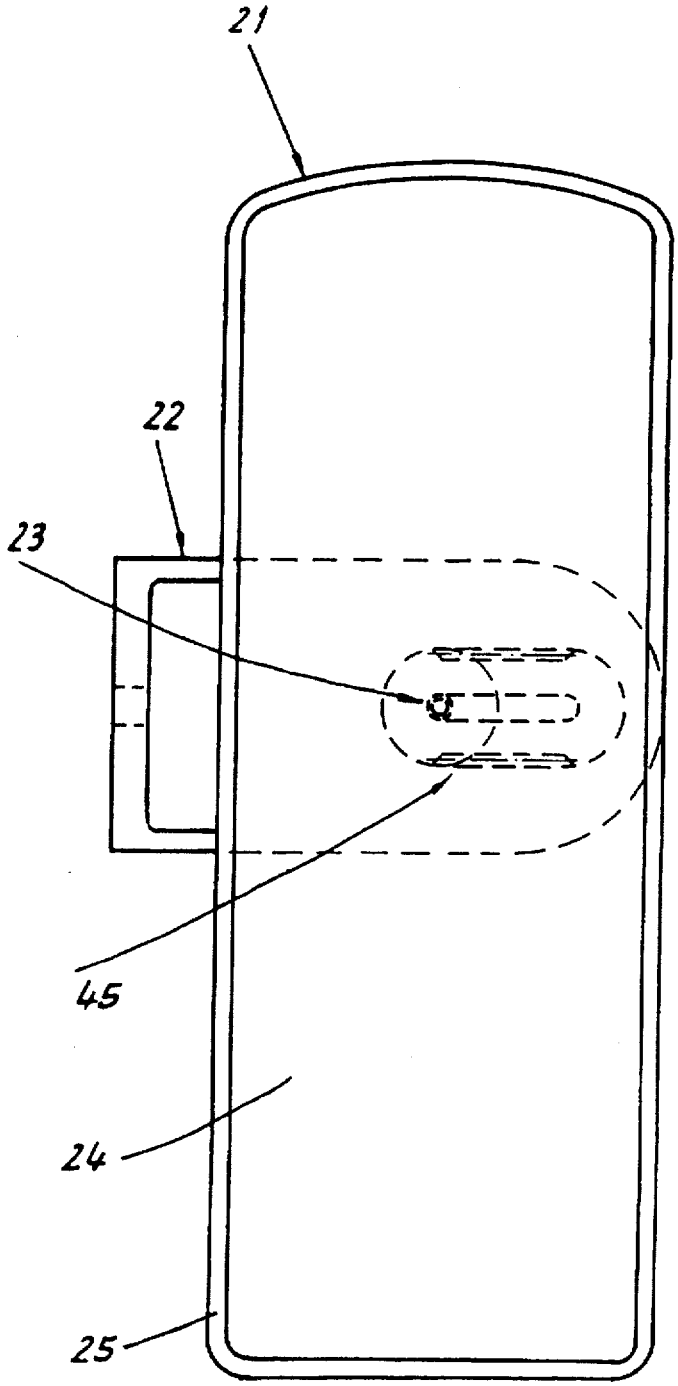
FIG. 7 is a view, corresponding to FIG. 2, of a modified embodiment.
Figure 9:
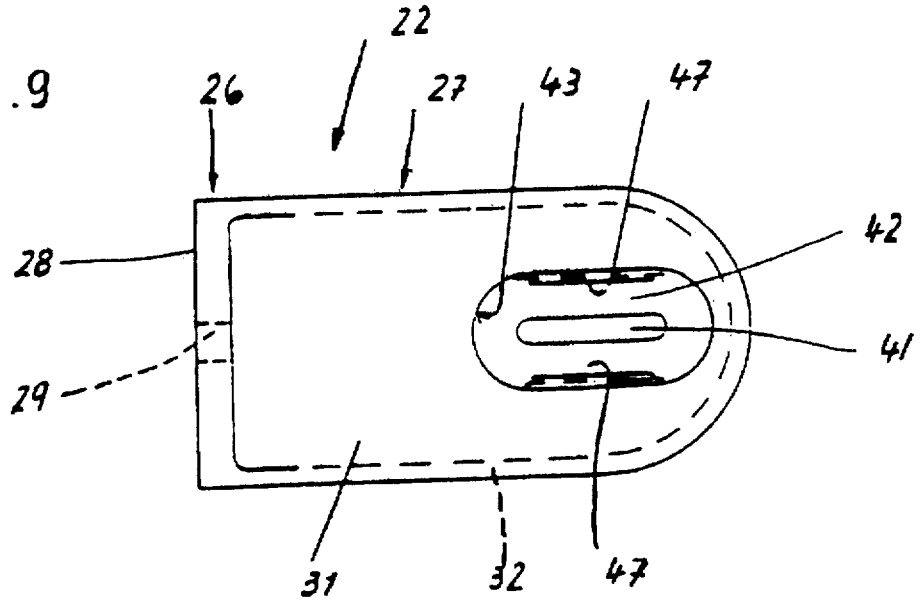
FIG. 9 is a view, corresponding to FIG. 5, of the subject-matter of FIGS. 7 and 8.
Figure 10:
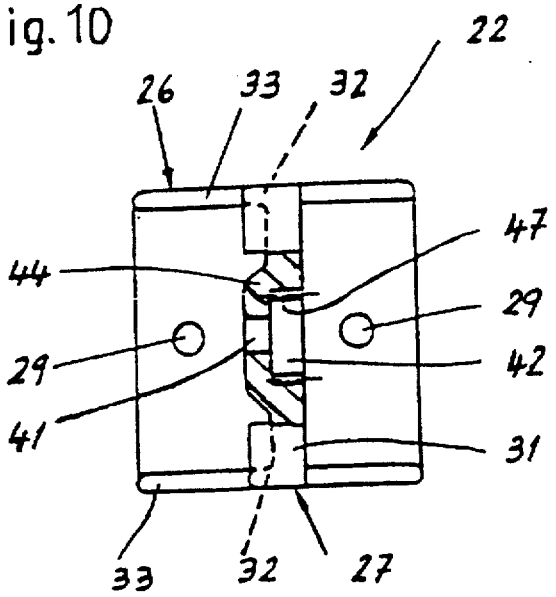
FIG. 10 is a view, corresponding to FIG. 6, of the same subject-matter.
Figure 11:
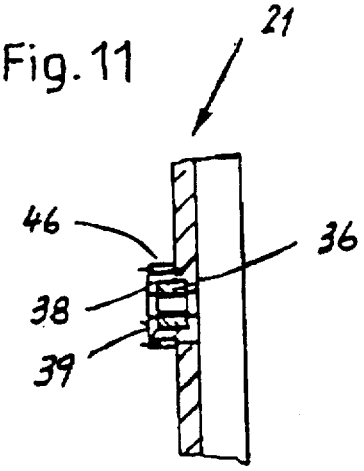
FIG. 11 illustrates a portion of the vertical sectional view of the guide member of the guide arrangement.

The holder 22 has a retaining foot 26 and a retaining arm 27 (FIG. 4 to FIG. 6). The holder 22 is configured as a one-piece shaped plastics material part and is produced from an elastically resilient and very tough plastics material, that is to say generally from the same plastics material as the guide member 21. The retaining foot 26 has an approximately rectangular configuration (FIG. 6). Its external surface remote from the retaining arm 27 forms the abutment face 28 of the retaining foot 26 for abutment against the guide wall element 10. At least one pair of through-slots 29 are provided in the retaining foot 26 and serve to secure the holder 22 on the guide wall element 10.

The retaining arm 27 is oriented normally relative to the abutment face 28. The main portion 31 of the retaining arm 27 has at least an approximately leaf-shaped configuration and has a rectangular outline subsequent to the retaining foot 26 and a semi-circular outline thereafter. The main portion 31 is provided along its edge with a circumferential reinforcing rib 32 which is disposed on the side remote from the guide member 21. In the region of the retaining foot 26, this circumferential reinforcing rib 32 passes into a respective supporting rib 33 which extends towards the edge of the retaining foot 26. There is no circumferential reinforcing rib, in fact, on the side facing the guide member 21, but a respective supporting rib 34 is fitted which is configured and disposed in a similar manner to the two supporting ribs 33 on the other side.

The coupling device 23 (FIG. 3) has a headed screw 35 as well as a nut 36 and a washer 37. The head and the subsequent portion of the shank of the headed screw 35 are so shaped in the guide member 21 that the threaded shank on the side remote from the guide face 24 protrudes from the guide member 21 and is thereby orientated normally relative to the abutment face 24. An extension 38, with a flat end face 39, is fitted on the guide member 21 on the side remote from the guide face 24 in the region of the screw 35. The extension 38 additionally surrounds the head of the headed screw 35 and the first portion of its shank and thereby simultaneously reinforces the guide member 21. The extension 38 has a circular cross-section and is configured either as a circular cylinder or as a truncated cone with a very small conical angle.

A through-slot for the shank of the headed screw 35 is provided on the retaining arm 27 as an additional part of the coupling device 23. This through-slot is configured as elongate slot 41 (FIG. 5). In the region of this elongate slot 41, a recess 42 is provided on the side of the retaining arm 27 facing the guide member 21, the circumferential wall 43 of said recess being equidistant from the circumferential wall of the elongate slot 41, whereby the base of the recess 42 is flat. The recess 42 accommodates the extension 38 of the guide member 21 and is accordingly adapted to the shape and dimensions thereof, whereby the fit between the circumferential wall of the extension 38 and the recess 42 is tighter than that between the circumferential wall of the elongate slot 41 and the threaded shank of the headed screw 35. In the region of the recess 42, the main portion 31 of the retaining arm 27 on the side remote from the guide member has a curved portion 44 (FIG. 6), so that the retaining arm 27 is not weakened by the recess 42.

The guide face 24 of the guide member 21 is advantageously covered with a reflective film 45 whereby the inclinedly extending strips painted red and white alternate with one another in conventional manner, as illustrated in FIG. 1.

The embodiment illustrated in FIGS. 7 to 11 corresponds basically to the embodiment shown in FIGS. 1 to 6. The type of connection between the guide member and the retaining arm is different.

The coupling device 23 has an adjustment device 45. One part of the adjustment device 45 is formed by an external toothing 46, which is fitted on the circumferential face of the extension 38 of the guide member 21. The other part of the adjustment device 45 is formed by an internal toothing 47, which is adapted to the external toothing 46 and is disposed on the rectilinear portions of the circumferential wall 43 of the recess 42 extending parallel to the elongate slot 41. In dependence on the spacing between the external toothing 46 and the internal toothing 47, the guide member 21 can be adjusted to different fixed rotary positions relative to the retaining arm 27, that is to say independently of the horizontal relative position of the extension 38 in the recess 42. Conversely, the spacing between the guide member 21 and the retaining foot 26 internally of the length of the elongate slot 41 and of the recess 42 can be adjusted independently of the rotary position of the guide member 21.

Contrary to the coupling device according to claims 1 to 6, where the connection is established by friction-locking, the operation is effected with form-locking in the embodiment according to FIGS. 7 to 11. The form-locking is achieved when the external toothing 46 engages in the internal toothing 47 in any desired rotary positions and at any desired spacing from the guide wall. The use of form-locking ensures that, even if the screw-connection possibly becomes loose, the position of the guide member is still maintained.

I claim:

1. Guide arrangement for guide walls, comprising:

a. a holder (22) comprising a retaining foot (26) that has an abutment face for orientation towards a guide wall and a securing means (29) disposed in the retaining foot, and wherein said holder further comprises a retaining arm (27) which protrudes from the retaining foot (26) from a side remote from the abutment face (28) wherein said retaining arm is elastically resilient at least in the horizontal direction, b. a guide member (21) comprising a guide face on at least one side, c. a coupling device (23) for coupling the guide member (21) to the retaining arm (27), wherein a headed screw (35) is fitted on the guide member (21) as part of the coupling device (23) so that it protrudes from the guide member (21) on a side remote from the guide face (24), and wherein said retaining arm (27) further comprises a through-slot (41) in alignment with the headed screw (35), wherein said guide member further comprises an extension (38) having a flat end face (39) aligned parallel to the guide member (21), wherein the extension (38) is in the region of the headed screw on the guide member (21) on the side remote from the guide face (24), and wherein said retaining arm (27) further comprises a recess (42), which is adapted to the extension (38) of the guide member (21).

2. Guide arrangement according to claim 1, wherein said guide member (21) comprises an approximately rectangular configuration.

3. Guide arrangement according to claim 1, wherein said guide member (21) further comprises a reinforcing rib (25) which extends along an edge of said guide member.

4. Guide arrangement according to claim 1, wherein said retaining foot (26) further comprises an approximately rectangular configuration with at least one pair of through-slots (29) which are disposed in a horizontal direction with a mutual spacing between, and wherein said retaining arm (27) is disposed in the longitudinal centre of the retaining foot (26), wherein said retaining arm (27) has at least an approximately leaf-shaped configuration, and wherein said retaining arm (27), on a side remote from the guide member (21), comprises a circumferential reinforcing rib (32) along its edge.

5. Guide arrangement according to claim 4, wherein at a transitional location between the retaining foot (26) and the retaining arm (27), said holder further comprises at least one respective reinforcing rib.

6. Guide arrangement according to claim 4, wherein said holder further comprises two supporting ribs (33, 34), at a transitional location between the retaining foot (26) and the retaining arm (27), which are disposed on both sides of the retaining arm, one above the other, with a mutual spacing between.

7. Guide arrangement according to claim 1, wherein said holder further comprises a through-slot (41) and wherein said through-slot is part of the coupling device (23) which couples the guide member (21) and the retaining arm (27), wherein a headed screw (35) with nut (36) is insertable into the through-slot.

8. Guide arrangement according to claim 7, wherein the through-slot for the headed screw (35) comprises an elongated slot (41) in the retaining arm (27) and is orientated parallel to a longitudinal central axis of the retaining arm (27), and wherein the recess (42) comprises an elongated recess which extends parallel to the elongated slot (41).

9. Guide arrangement according to claim 1 or 8, wherein the extension (38) of the guide member (21) comprises a circular cross-section.

10. Guide arrangement according to claim 1, wherein a headed screw (35) is fitted on the guide member (21) as part of the coupling device (23) so that it protrudes from the guide member (21) on a side remote from the guide face (24), and wherein said retaining arm (27) further comprises a through-slot (41) in alignment with the headed screw (35).

11. Guide arrangement according to claim 1, wherein parts of the coupling device (23) co-operate by form-locking.

12. Guide arrangement according to claim 1, wherein the guide face (24) of the guide member (21) comprises colored markings.

13. Guide arrangement according to claim 1, wherein the guide face (24) of the guide member (21) further comprises a reflective film (45).

14. Guide arrangement for guide walls, comprising:

a. a holder (22) comprising a retaining foot (26) that has an abutment face for orientation towards a guide wall and a securing means (29) disposed in the retaining foot, and wherein said holder further comprises a retaining arm (27) which protrudes from the retaining foot (26) from a side remote from the abutment face (28) wherein said retaining arm is elastically resilient at least in the horizontal direction, b. a guide member (21) comprising a guide face on at least one side, c. a coupling device (23) for coupling the guide member (21) to the retaining arm (27), wherein a headed screw (35) is fitted on the guide member (21) as part of the coupling device (23) so that it protrudes from the guide member (21) on a side remote from the guide face (24), and wherein said retaining arm (27) further comprises a through-slot (41) in alignment with the headed screw (35), wherein said guide member further comprises an extension (38) having a flat end face (39) aligned parallel to the guide member (21), wherein the extension (38) is in the region of the headed screw on the guide member (21) on the side remote from the guide face (24), and wherein said retaining arm (27) further comprises a recess (42), which is adapted to the extension (38) of the guide member (21), wherein the extension (38) further comprises an external toothing (46) disposed on a circumferential face of the extension (38), wherein said extension comprises a circular cross-section, and wherein the recess (42) further comprises an internal toothing (47) on rectilinear portions of a circumferential wall (43) of the recess (42), which portions extend parallel to the elongate slot (41), and wherein the internal toothing (47) is adapted to the external toothing (46).

15. Guide arrangement according to claim 14, wherein the extension (38) of the guide member (21) further comprises a threaded portion and wherein the headed screw (35) extends through the elongate slot (41) form a side of the retaining arm (27) remote from the guide member (21) and is screwed into the threaded portion (36).

* * * * *